US008069986B2

(12) United States Patent
Darr et al.

(10) Patent No.: US 8,069,986 B2
(45) Date of Patent: Dec. 6, 2011

(54) STACKABLE CONTAINER WITH ANGLED NECK FINISH

(75) Inventors: Richard C. Darr, Medina, OH (US); James J. Miller, Barberton, OH (US); Richard A. Lovelace, Jr., Munroe Falls, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 458 days.

(21) Appl. No.: 11/836,895

(22) Filed: Aug. 10, 2007

(65) Prior Publication Data

US 2008/0190944 A1 Aug. 14, 2008

Related U.S. Application Data

(63) Continuation-in-part of application No. 29/272,726, filed on Feb. 13, 2007, now Pat. No. Des. 586,664.

(51) Int. Cl.
*B65D 21/00* (2006.01)
*B65D 85/62* (2006.01)

(52) U.S. Cl. ..... 206/509; 206/511; 215/382; 215/383; 215/384; 220/660; 220/669; 220/670; 220/672; 220/675

(58) Field of Classification Search ..... 206/509, 206/511; 215/382–384; 220/660, 669, 670, 220/672, 675, 745
See application file for complete search history.

(56) References Cited

U.S. PATENT DOCUMENTS 4,308,955 A * 1/1982 Schieser et al. ..... 206/509
4,728,006 A 3/1988 Drobish et al.
4,733,804 A * 3/1988 Slat et al. ..... 222/465.1
5,002,199 A * 3/1991 Frahm ..... 220/670
5,178,817 A 1/1993 Yamada et al.
5,244,021 A * 9/1993 Hau ..... 141/285
5,890,595 A * 4/1999 Credle, Jr. ..... 206/501
6,206,218 B1 3/2001 Young et al.
6,237,792 B1 * 5/2001 Skolnicki et al. ..... 215/382
D459,990 S 7/2002 Young et al.
6,588,612 B1 7/2003 Dorn et al.
6,692,682 B2 * 2/2004 Ferguson et al. ..... 264/512
6,696,010 B2 2/2004 Ferguson et al.
6,932,228 B1 8/2005 Darr et al.
7,033,535 B1 4/2006 Limanjaya (Continued)

OTHER PUBLICATIONS

International Searching Authority/US; International Search Report and Written Opinion for PCT/ US2008/072441 .

*Primary Examiner* — Anthony Stashick
*Assistant Examiner* — Madison L Wright
(74) *Attorney, Agent, or Firm* — Dykema Gossett PLLC

(57) ABSTRACT

A blow molded plastic container is disclosed that includes a bottom portion, a top portion and a body portion. In an embodiment, the body portion includes side portions and includes at least one side portion that has a support protrusion extending therefrom. The top portion is connected to the body portion and includes a dispensing opening. The bottom portion is connected to the side portions. In an embodiment, when the container is positioned to rest on a surface on a side portion, the centerline axis of the dispensing opening is angled with respect to a plane formed by said surface. Embodiments of a container in which the side portion opposing the side support portion includes a receiving portion for receiving at least a portion of the support protrusion from a second similarly configured container are also disclosed.

32 Claims, 23 Drawing Sheets

U.S. PATENT DOCUMENTS

| | | | | |
|---|---|---|---|---|
| 7,520,399 | B2 * | 4/2009 | Lane et al. | 215/10 |
| 2003/0132184 | A1 | 7/2003 | Dorn et al. | |
| 2003/0132186 | A1 | 7/2003 | Ferguson et al. | |
| 2004/0129669 | A1 | 7/2004 | Kelley et al. | |
| 2006/0096942 | A1 | 5/2006 | Lane | |
| 2007/0114200 | A1 | 5/2007 | Lane | |

* cited by examiner

STACKABLE CONTAINER WITH ANGLED NECK FINISH

CROSS-REFERENCE TO RELATED APPLICATION

This application is a continuation-in-part of U.S. patent application Ser. No. 29/272,726 for NESTABLE PLASTIC CONTAINER, filed Feb. 13, 2007, which is incorporated herein in its entirety by reference.

TECHNICAL FIELD

The present invention relates generally to plastic containers, including plastic containers having an angled dispensing opening.

BACKGROUND

Plastic containers are widely used commercially for a variety of products. These include plastic containers of widely varying sizes depending upon the associated product and commercial needs.

SUMMARY

According to an aspect of the invention, a blow molded plastic container is provided that comprises a bottom portion, a top portion and a body portion. In an embodiment, the body portion includes side portions, which include at least one side support portion that includes a support protrusion extending therefrom. The top portion is connected to the body portion and includes a dispensing opening. The bottom portion is connected to the side portions. In an embodiment, when the container is positioned to rest on a surface on a side portion, the centerline axis of the dispensing opening is angled with respect to a plane formed by said surface. Embodiments of a container in which the side portion opposing the side support portion includes a receiving portion for receiving at least a portion of the support protrusion from a second similarly configured container are also disclosed.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1A:
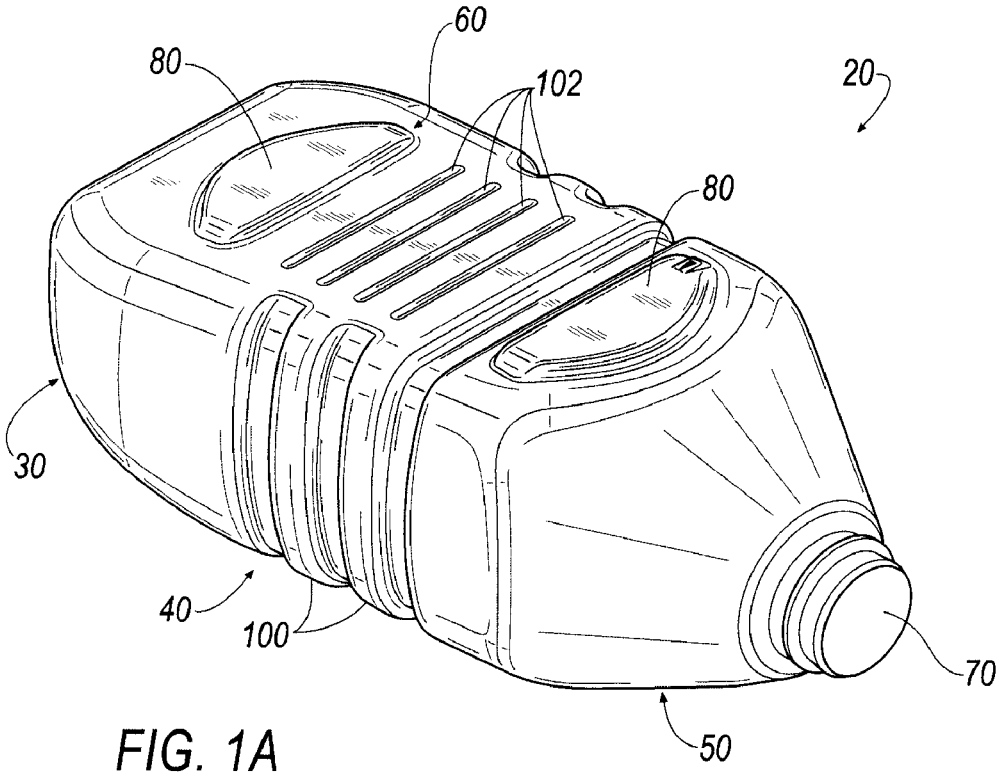
FIGS. 1A and 1B are top, rear and left side perspective views of plastic containers according to embodiments of the invention.
Figure 1B:
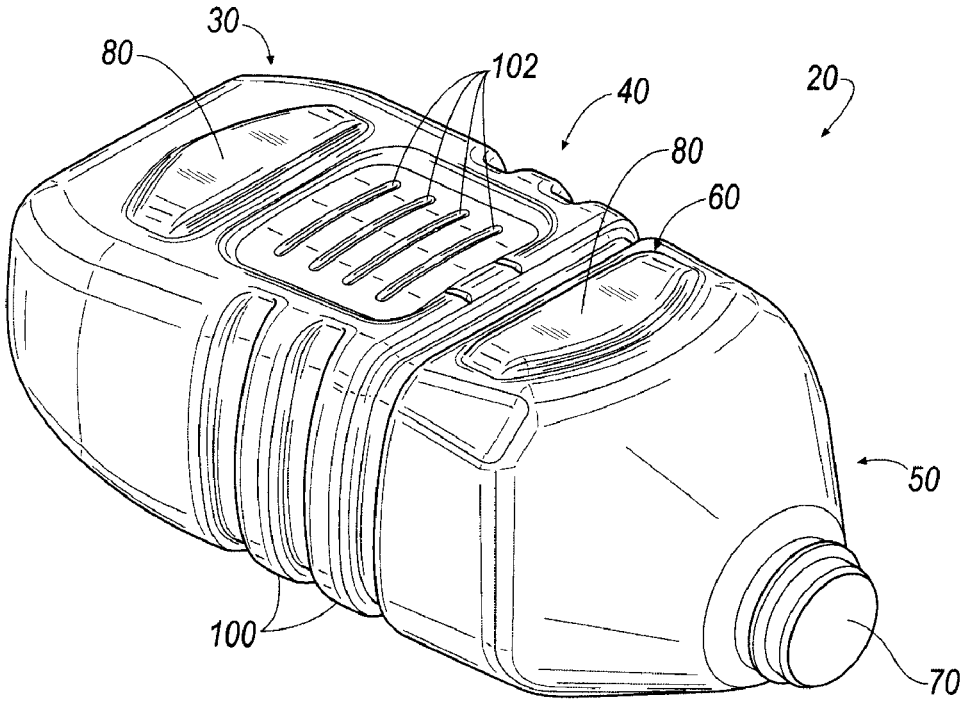
Figure 2A:
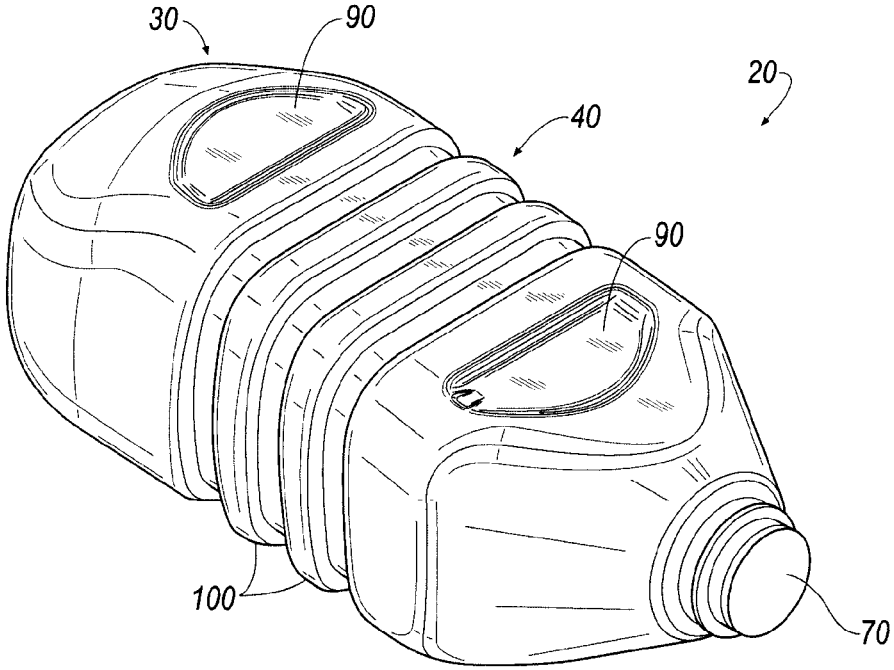
FIGS. 2A and 2B are top, rear and left side perspective views of the containers illustrated in FIGS. 1A and 1B, respectively.
Figure 2B:
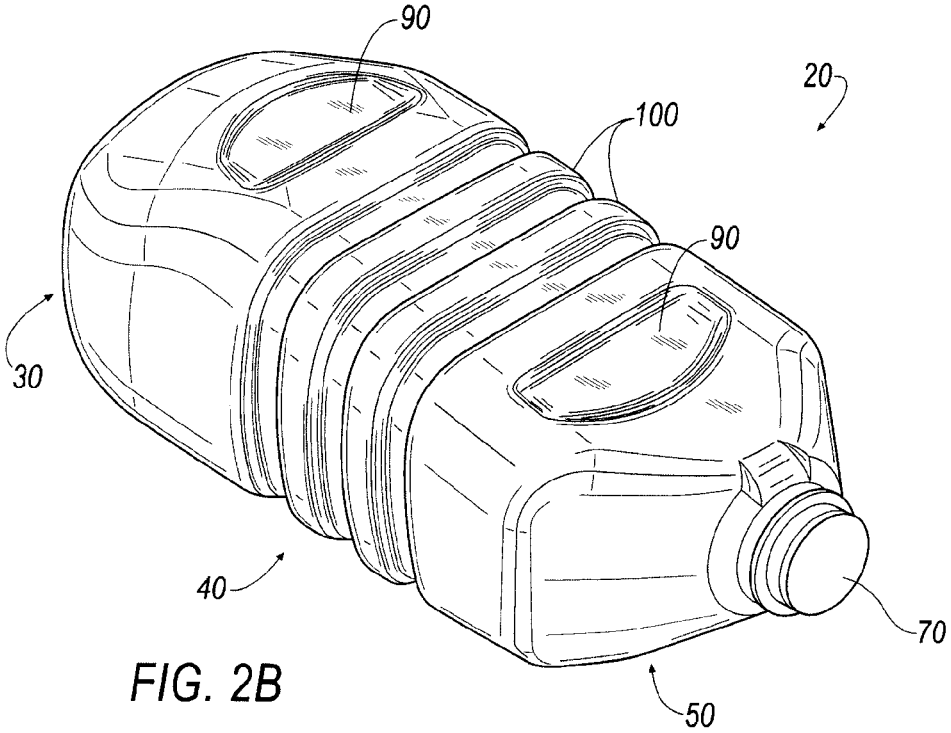

FIGS. 1A and 1B depict different perspective views of containers 20 exhibiting features of the invention. As generally illustrated, each container 20 includes a bottom portion 30, a body portion 40, and a top portion 50. By way of example, and without limitation, several embodiments of the container are illustrated herein. Figures designated with a number preceding the letter "A" generally designate an embodiment of a plastic container formed in accordance with features of the present invention. Figures designated with a number preceding the letter "B" generally designate another embodiment of a container formed in accordance with features of the present invention. Figures designated with a number preceding the letter "C" generally designate yet another embodiment of a container formed in accordance with features of the present invention. Figures designated with a number preceding the letter "D" generally designate still yet another embodiment of a container formed in accordance with features of the present invention.

With further reference to FIGS. 1A and 1B, bottom portion 30 may be configured to support container 20 in a "standing" or "upright" position on a surface. Further, bottom portion 30 may generally correspond to the lower portion of the container, or the portion of the container furthest from the neck receiving portion, in connection with the molding or formation of the container.

Body portion 40 extends from bottom portion 30 and includes at least one side support portion 60 that is configured to, at least in part, to support container 20 on a surface or to potentially support another article, such as a similar container, on top of container 20. In an embodiment, body portion 40 is substantially rectangular. For some applications, the associated surface may be an environmental surface, such as a floor or shelf. For other applications, the surface may be a surface or portion associated with another container. The top portion 50 is connected to the body portion and includes a dispensing opening 70.

If desired, dispensing opening 70 may be substantially round or cylindrical and may, as generally illustrated in the embodiments, extend outwardly from top portion 50. Moreover, for a number of applications, dispensing opening 70 may include threads or various other known means for securing a conventional closure. Further, for some embodiments, container 20 may include a separate dispensing device connected to the dispensing opening that may comprise a self-venting dispensing valve, such as one that can be operated by a user using a one-hand operation.

Referring to FIGS. 1A, 1B, 2A and 2B, at least one side support portion 60 includes at least one protruding support formation 80. An opposing side (e.g., the rear side if the front side includes a side support portion) may include a receiving portion 90. Receiving portion 90 may comprise a depression or recessed portion or portions for receiving at least a portion of a support formation 80 from another container having a similar configuration. With reference to FIGS. 5A-5D, protruding support formations 80 may extend a distance D from a plane generally formed by adjacent portions of body portion 40. Without limitation, distance D may range from 0.200 inches ±0.1 inches. For some embodiments, more than one protruding support formation 80 may be provided in connection with one or more side support portions 60. In embodiments in which a label is provided on a side support portion 60 (which may, for example, be provided between two protruding support formations 80) the distance D associated with the protruding support formations 80 will be such that the label should not typically contact the support surface when the container is supported on the surface by the side support portion 60. Further, where a plurality of protruding support formations (e.g., 80*a* and 80*b* in FIG. 5A) are provided on a side support portion 60, depending on the desired configuration of the side support portion 60, similar or different distances (D) may be associated with each formation. Further, without limitation, one support formation may be positioned adjacent the top portion 50, and another support formation on the same side portion may be positioned adjacent the bottom portion 30.

As generally illustrated in the embodiments of the containers 20 shown in FIGS. 3A-3D, 4A-4D, and 5A-5D, dispensing opening 70 may include a centerline axis CL. Further, for some embodiments of the invention, the centerline axis CL of the dispensing opening 70 is configured at an angle with respect to a plane formed by points or portions of bottom portion 30—that is, the plane formed by points or portions of bottom portion 30 that would contact a flat or planar surface of bottom portion 30. Such an angled dispensing opening 70 can permit easier or improved dispensing of a comparatively larger volume of container content when container 20 is positioned on a side in which the centerline axis CL is angled downwardly. For example, as generally illustrated in FIGS. 11A, 11B, 12A and 12*b*, when the containers are placed on a surface on the side opposite the side support portion 60, the centerline axis CL may be angled downwardly to some degree (relative to the plane of an associated surface) to assist with the dispensing of contents. However, the present invention is not limited to the illustrated configurations and also envisions and encompasses embodiments in which the centerline axis is angled downwardly when the associated container is positioned to rest on the side support portion 60.

In an embodiment, when container 20 is positioned to rest on a side portion of the container on a surface, the centerline axis CL of the dispensing opening may be angled downwardly at an angle (see, e.g., θ in FIG. 5A) with respect to a plane generally formed by the surface on which a side portion of the container rests. For some embodiments, the angle may be between about 5° and about 9° with respect to a plane formed by the surface. Moreover, for some embodiments, the centerline axis CL of the dispensing opening may be angled downwardly at an angle that is between about 7° and about 7.5° with respect to a plane formed by the surface. Again, the associated downward angle may be configured to, among other things, assist with a side-oriented dispensing of contents from a container.

By way of example, without limitation, in the embodiments illustrated in the drawing figures (e.g., FIGS. 3A-3D), each container 20 includes a side support portion 60 having two protruding support formations 80. An opposing side for each container, for example, the sides generally illustrated in FIGS. 4A-4D, may include two corresponding receiving portions 90.

Figure 3A:
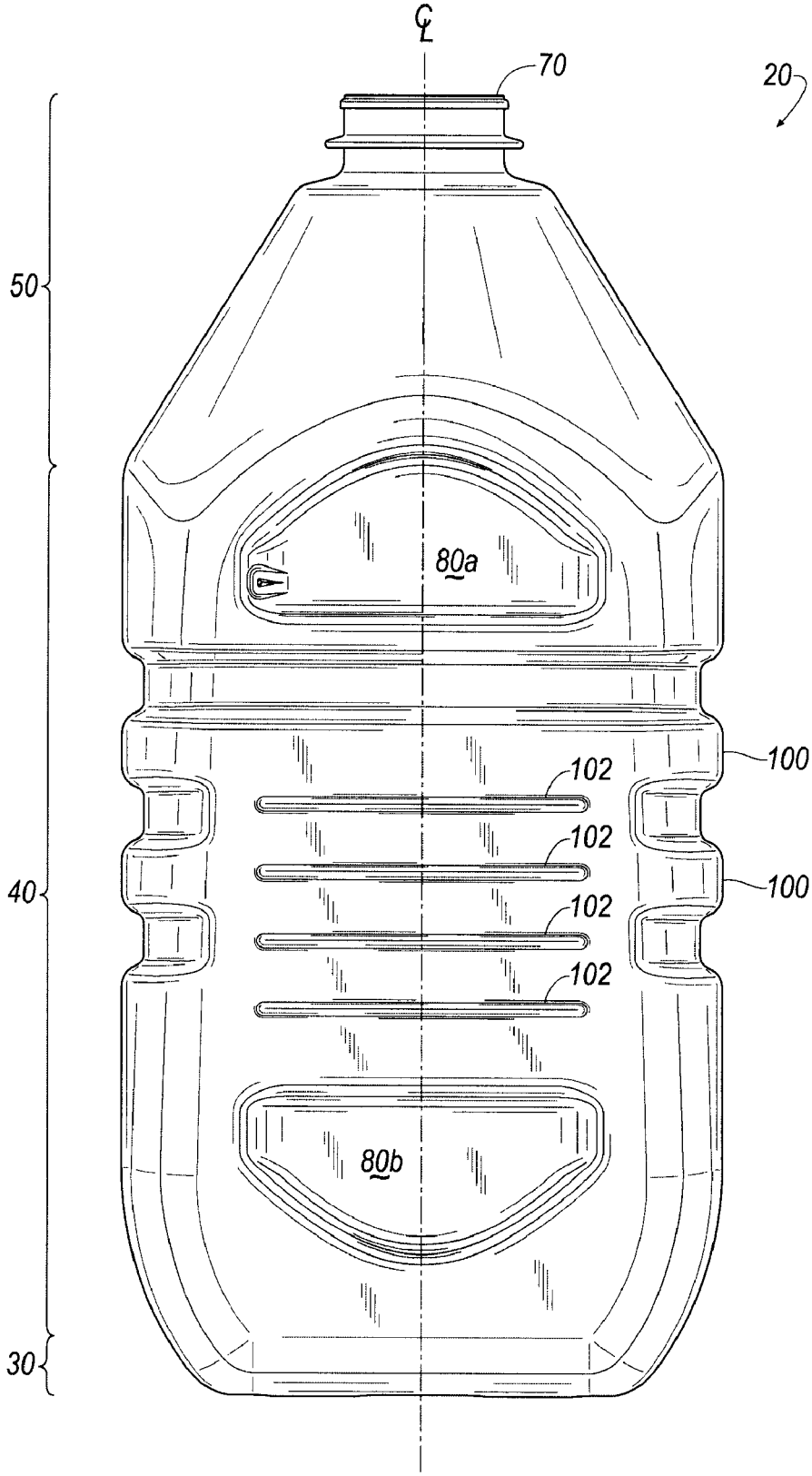
FIGS. 3A, 3B, 3C and 3D are front elevation views of embodiments of plastic container according to embodiments of the invention.
Figure 4A:
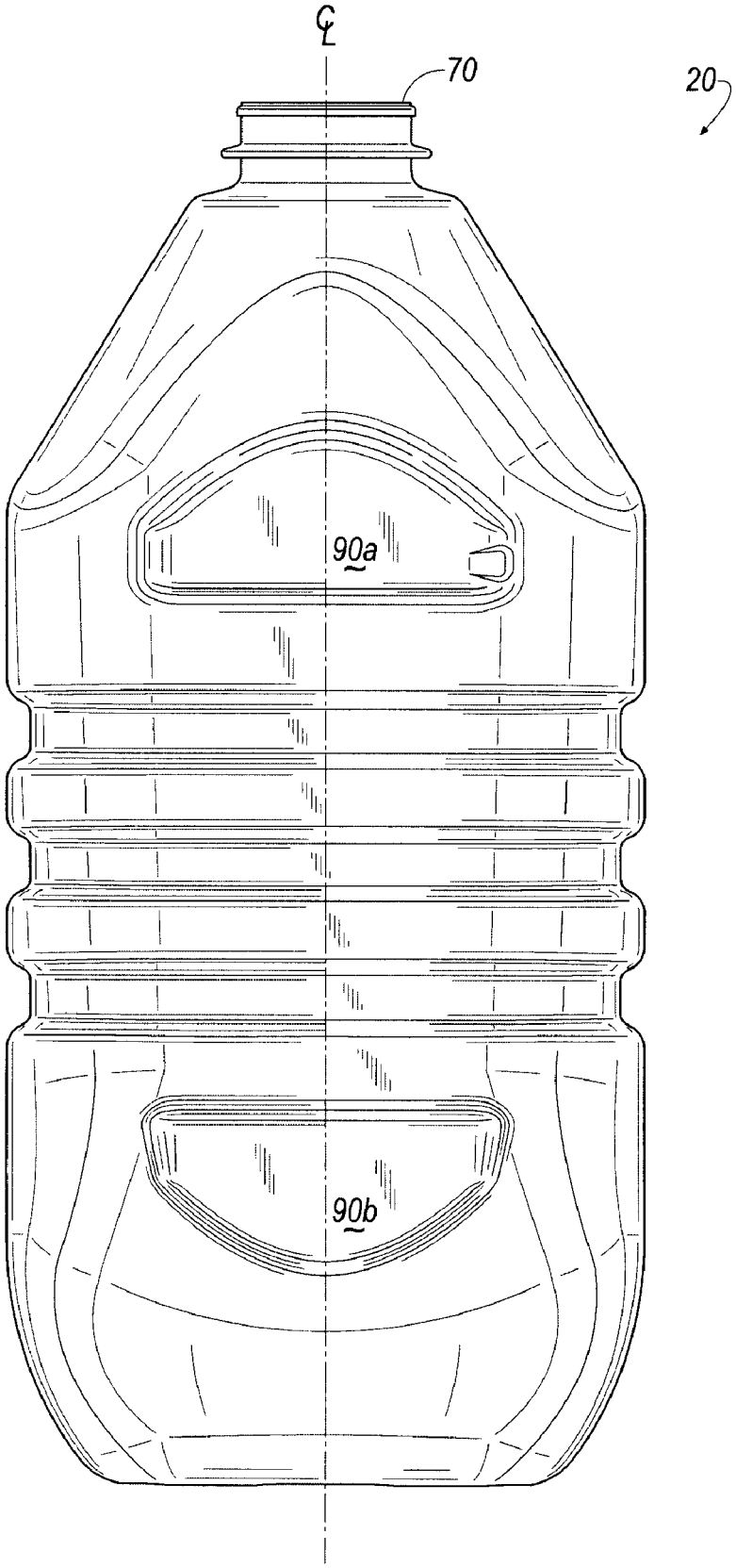
FIGS. 4A, 4B, 4C and 4D are rear elevation views of embodiments of plastic containers according to embodiments of the invention.
Figure 4B:
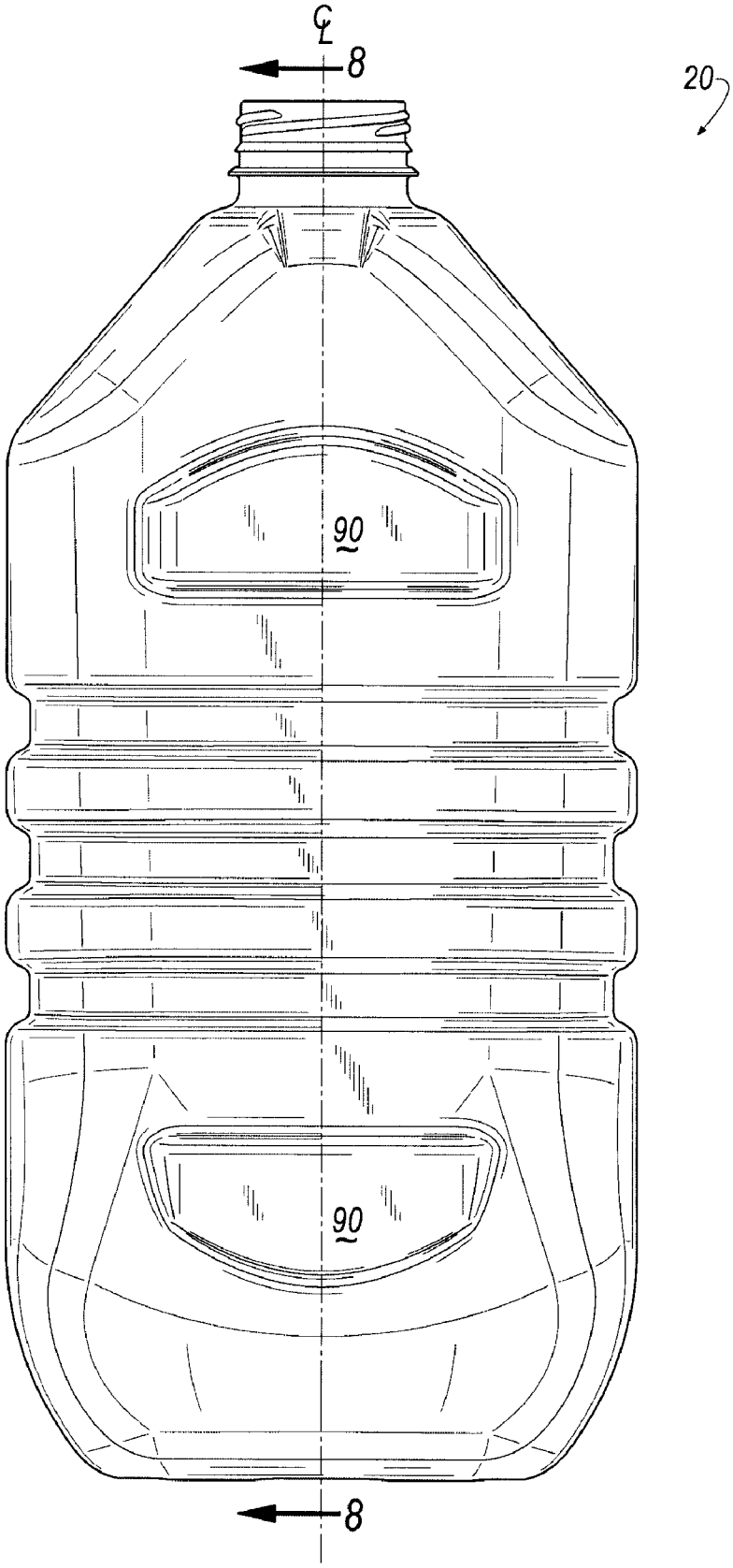
Figure 4C:
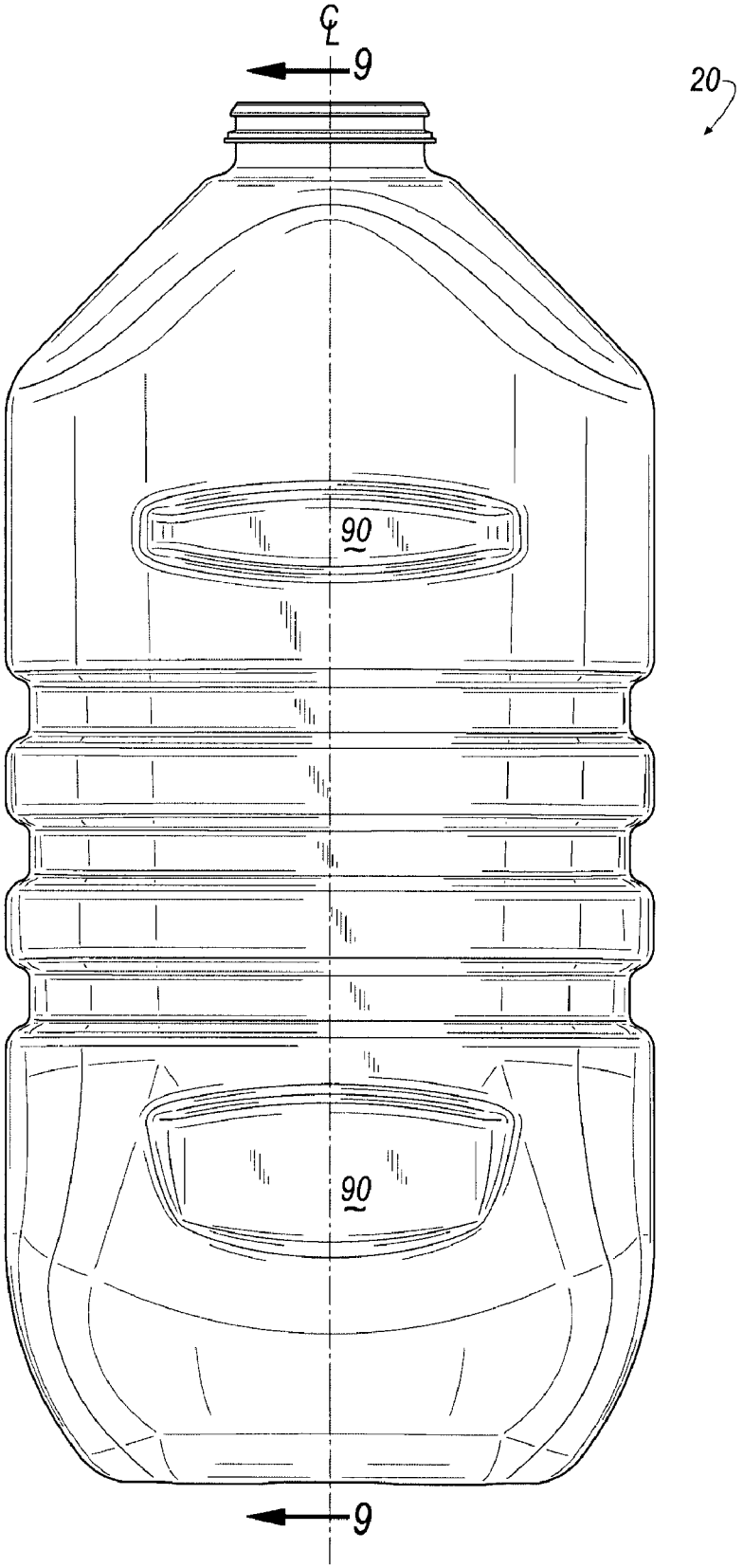
Figure 4D:
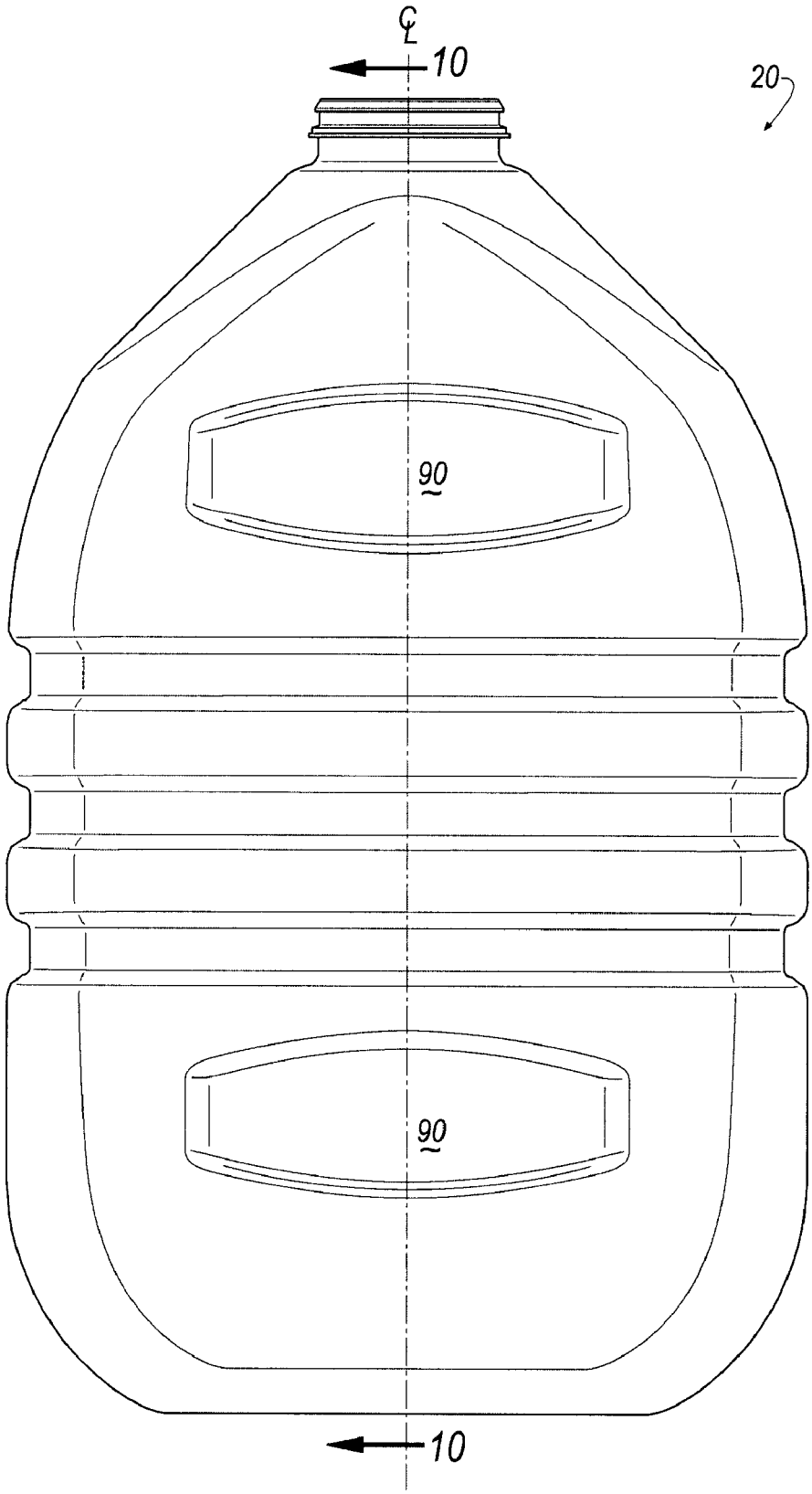

As generally viewed from a front elevation perspective, protruding support formations 80 may be provided in a variety of shapes. Non-limiting examples of protruding support formations 80*a*, 80*b* are shown in FIG. 3A. As generally shown in the illustrated examples, the protruding support formations 80 may comprise outwardly-projecting support pads and/or may include curved or generally rounded edges. Further, the protruding support formations 80 may be configured to, in addition to interfacing with a corresponding receiving portion 90, facilitate or improve associated molding or formation processes. With reference to FIGS. 3A and 4A, an embodiment of a container is provided with protruding support formations 80*a*, 80*b* and receiving portions 90*a*, 90*b*. If included, one or more receiving portions, such as 90*a* and 90*b*, generally are configured to receive a portion of one or more corresponding protruding support formations, such as 80A and 80B, respectively. In an embodiment, substantially the entire outermost radial surface of one or more protruding support formations 80 will be received within a corresponding receiving portion 90. Moreover, when "stacked" or interconnected, the majority (and for some embodiments, all or substantially all) of the surface area or volume associated with a protruding support formation may be received within an associated receiving portion of another similarly-configured container.

Further, as generally illustrated in the aforementioned drawing figures, body portion 40 may include one or more strengthening formations, such as, for example, strengthening ribs 100 and 102. In an embodiment, body portion 40 is provided with a plurality of strengthening ribs. Moreover, in some embodiments, such as those generally illustrated, each side of the body portion may include at least one strengthening rib 100. Further, for some embodiments one or more strengthening ribs may be positioned between two spaced-apart support formations on the same side portion of the container. It is noted that the strengthening formations anticipated in connection with the invention may take many forms, including various types and forms known to those of skill in the plastic container art.

Figure 3B:
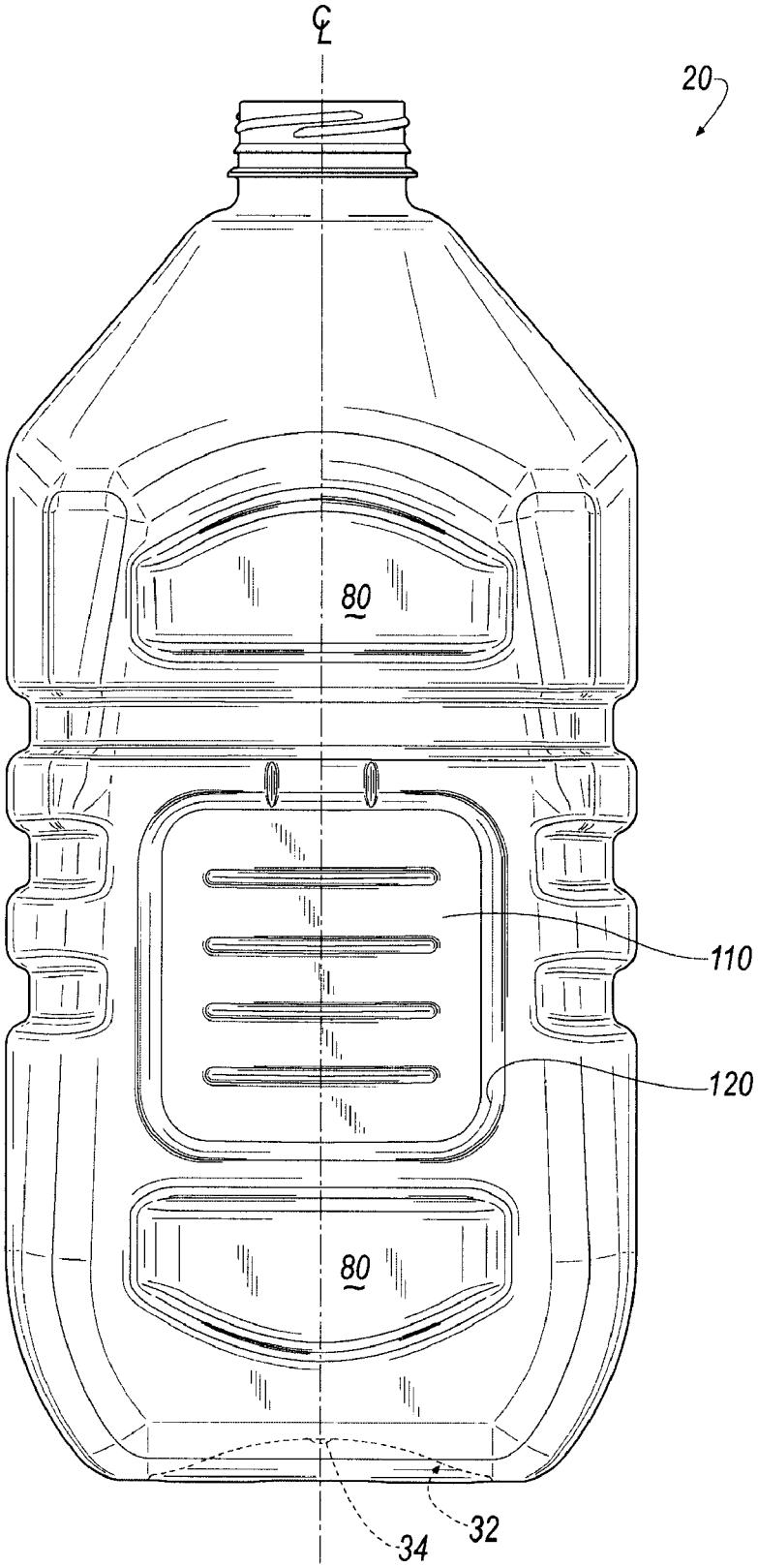
Figure 3C:
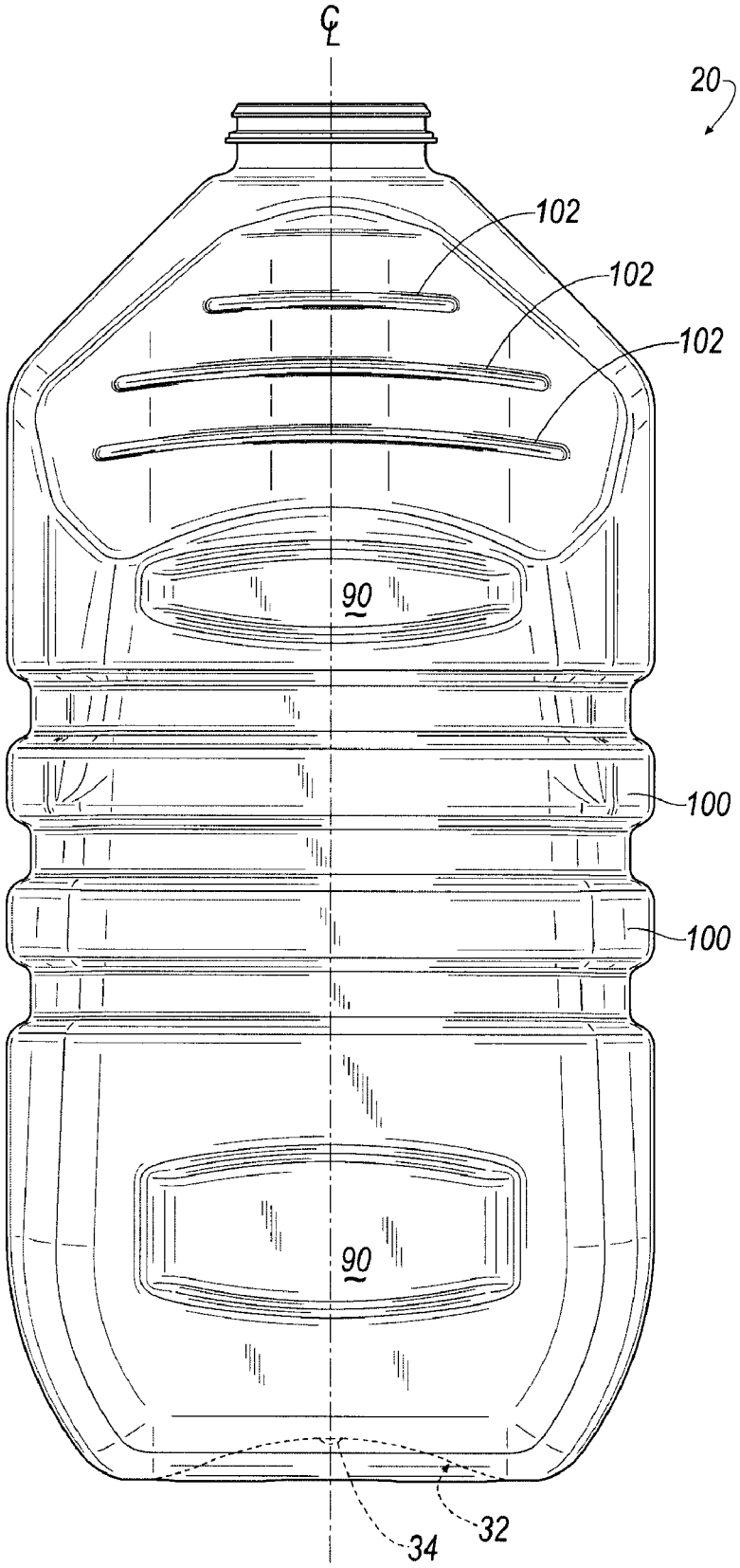
Figure 3D:
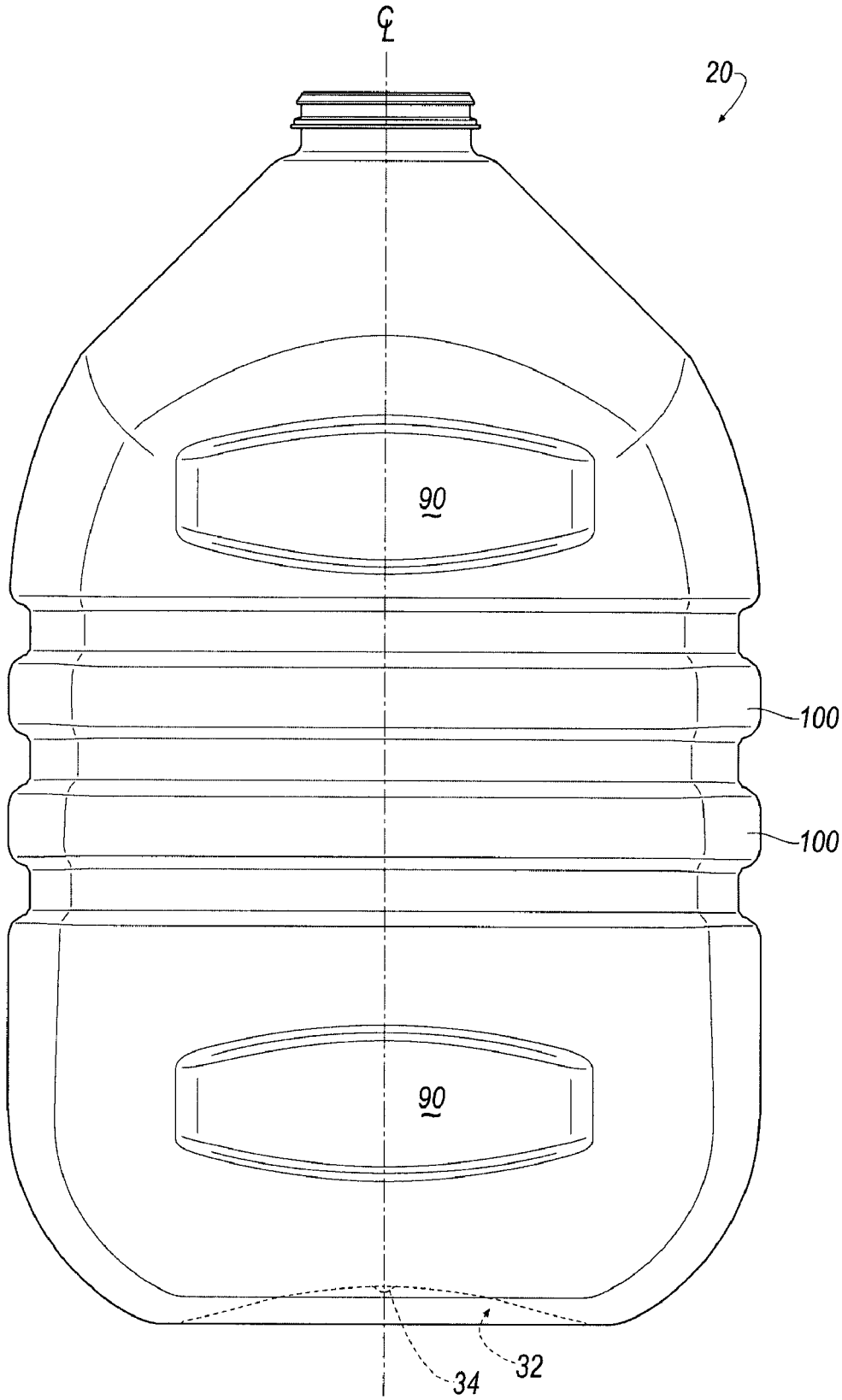

Additionally, as generally illustrated in FIG. 3B, container 20 may include one or more label panels 110. Such label panels 110 may or may not include formations, such as ridges 120, to fully or partially "frame" a label. In an embodiment, at least one side portion includes a label panel. However, the invention is not so limited and, in other embodiments, two or more side portions of the container may include one or more labels.

Figure 5A:
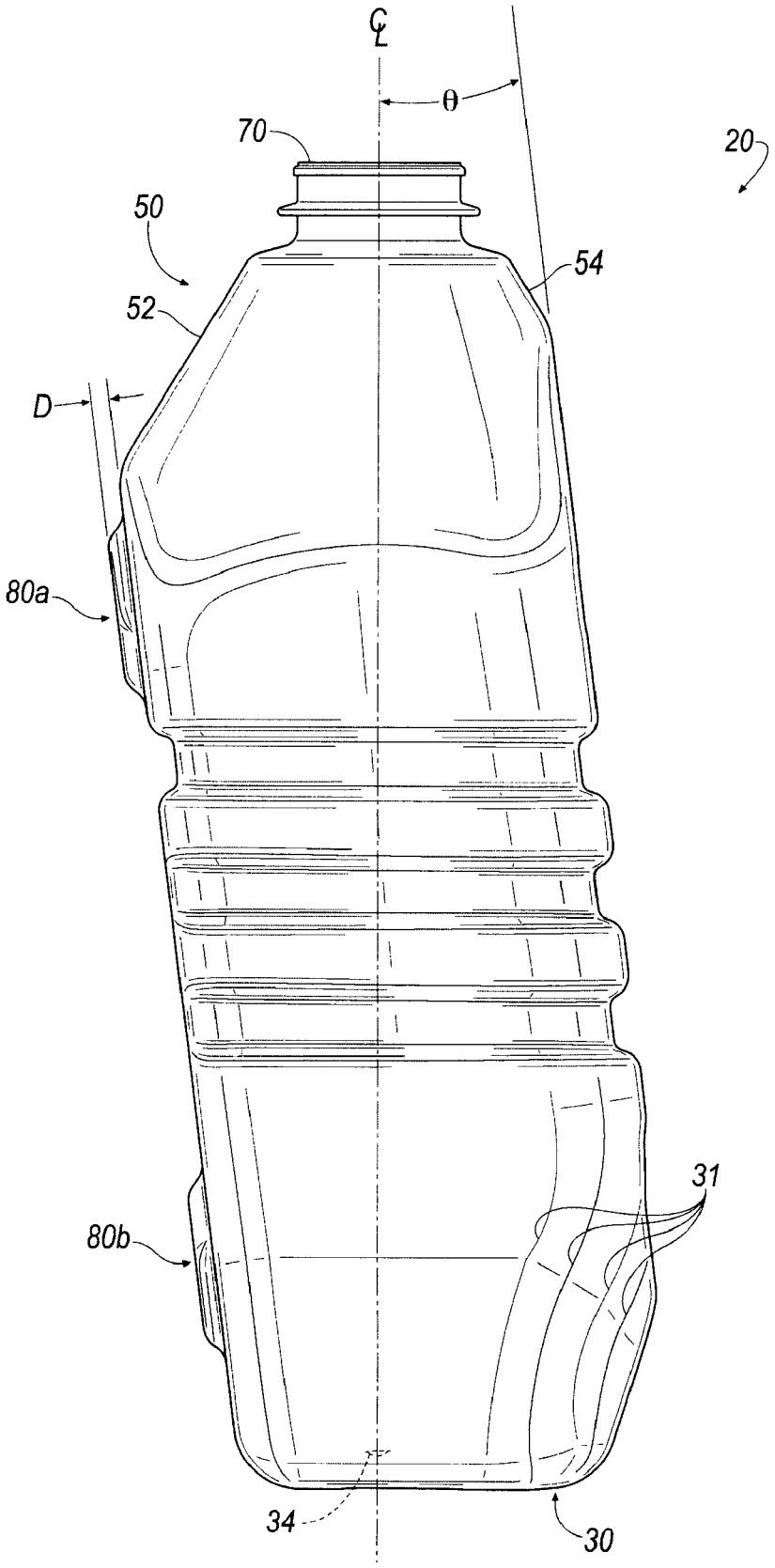
FIGS. 5A, 5B, 5C and 5D are right side views of embodiments of plastic containers according to embodiments of the invention; the left side views of such containers are essentially mirror images of the respective right side views.
Figure 5B:
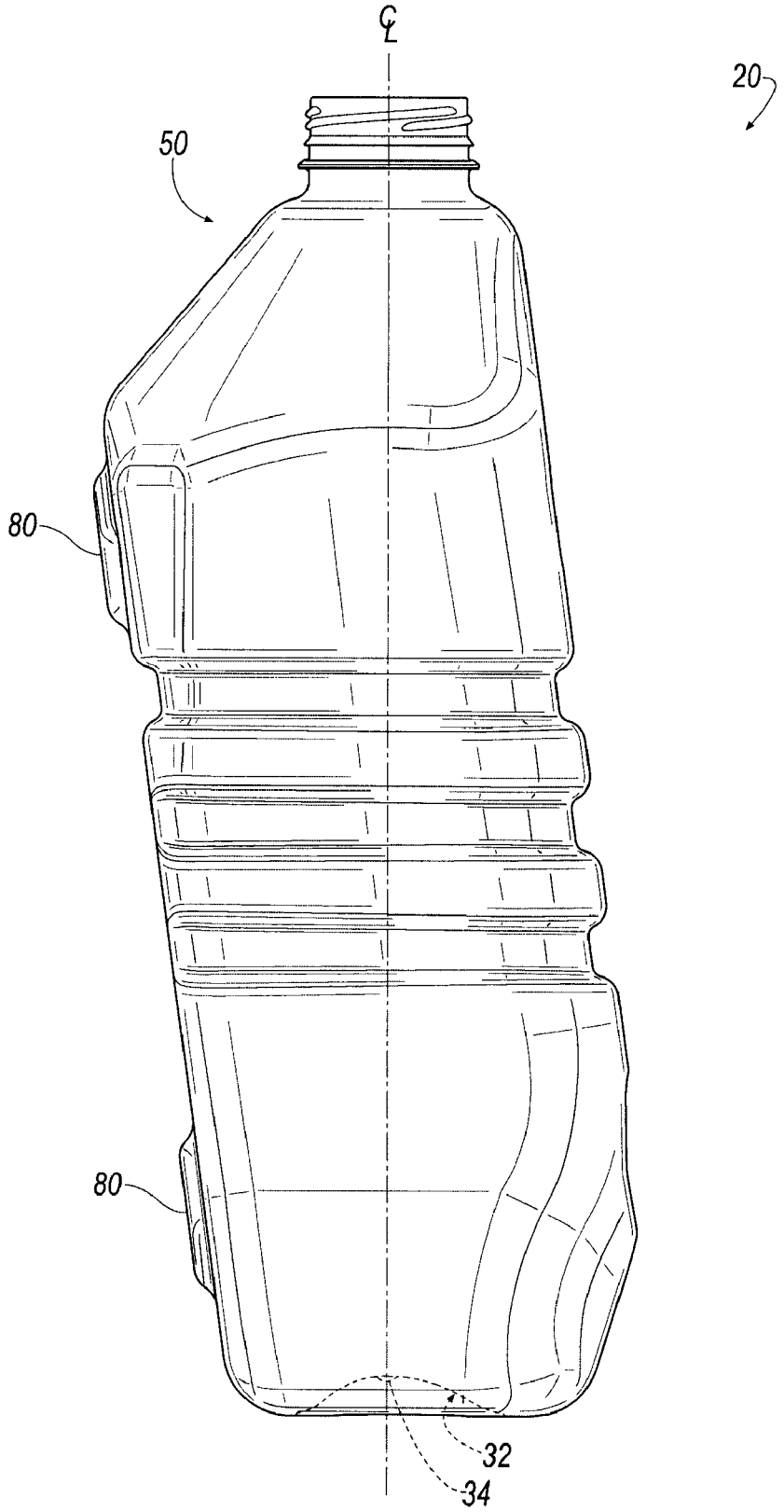
Figure 5C:
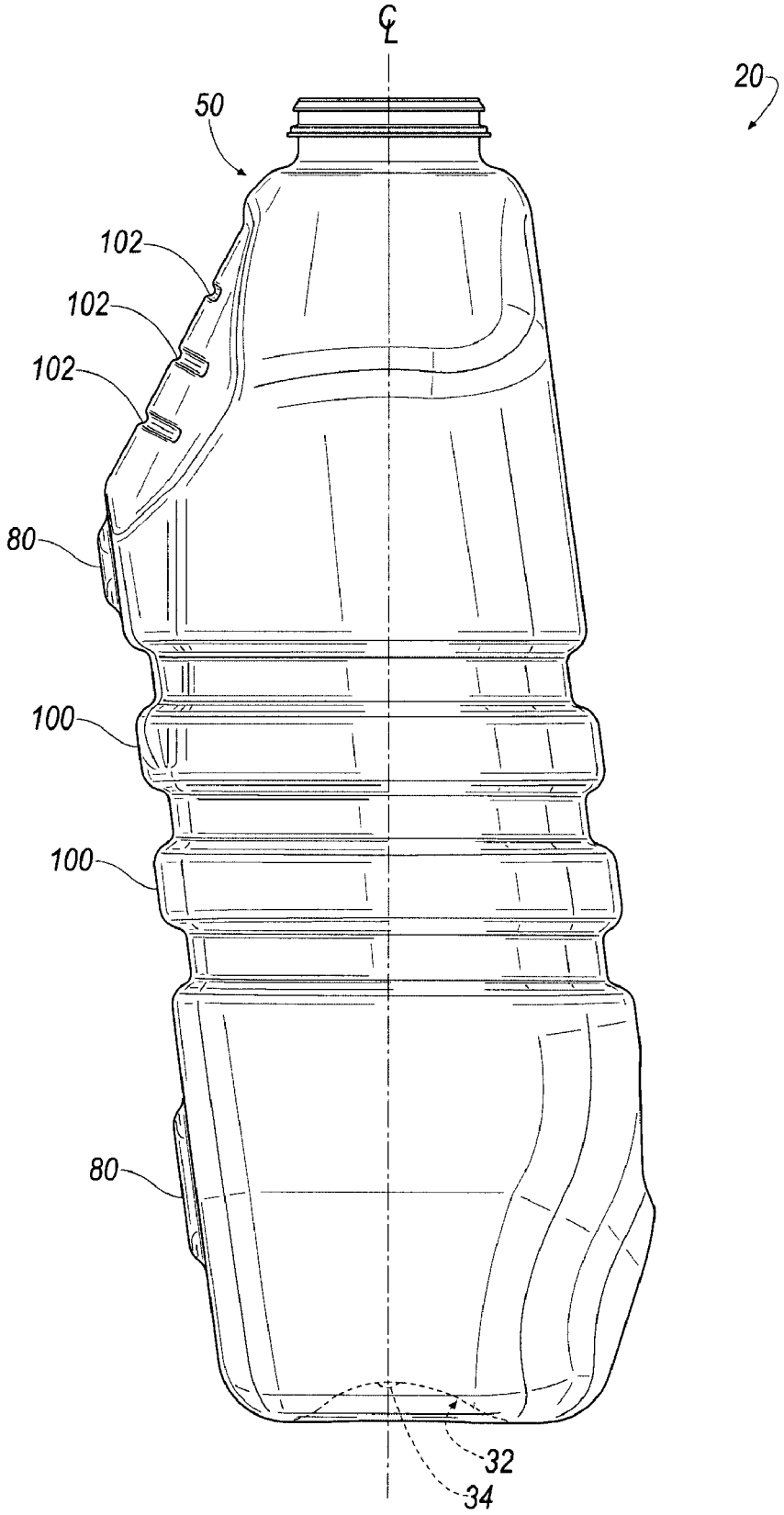
Figure 5D:
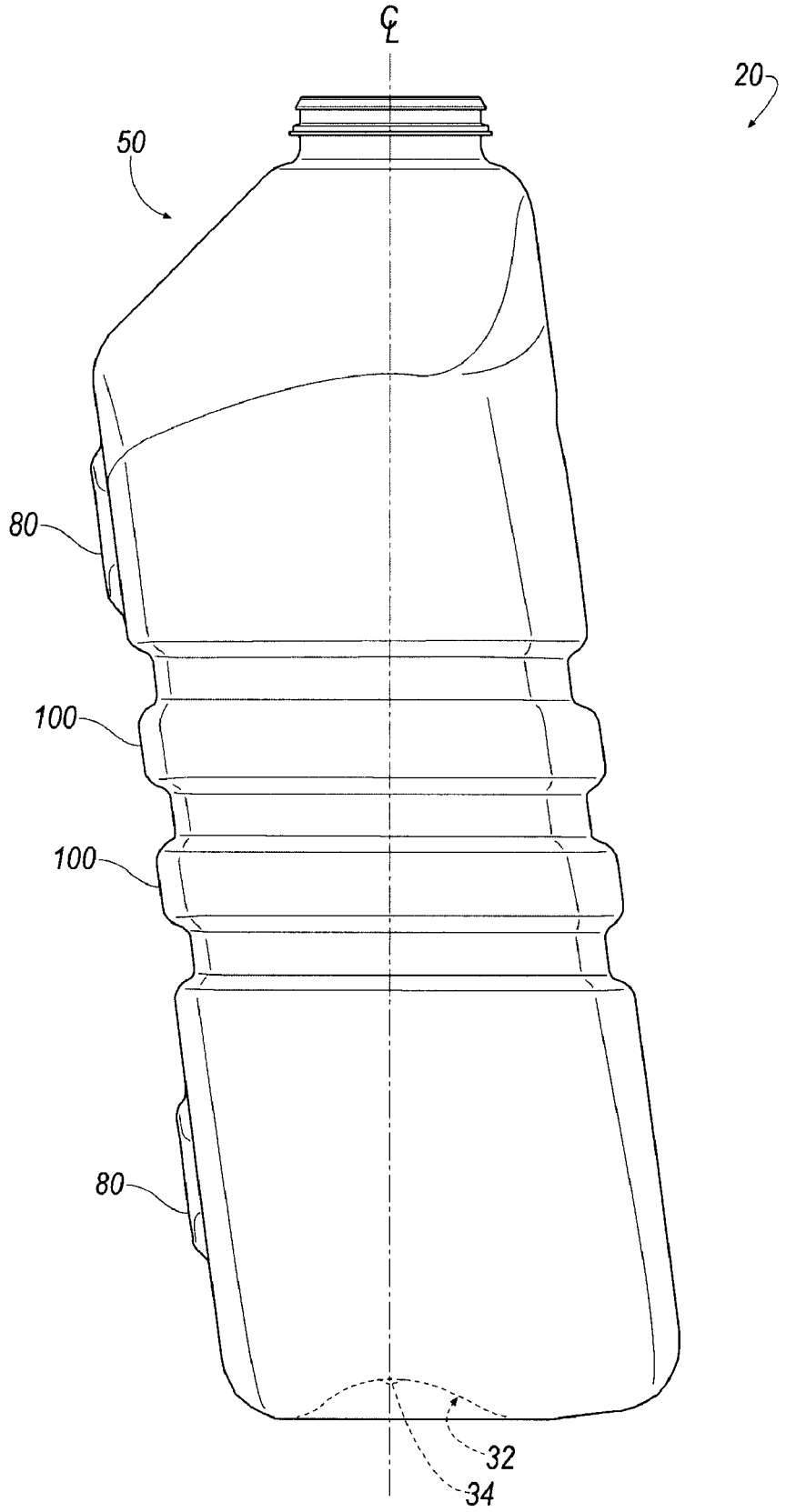
Figure 6A:
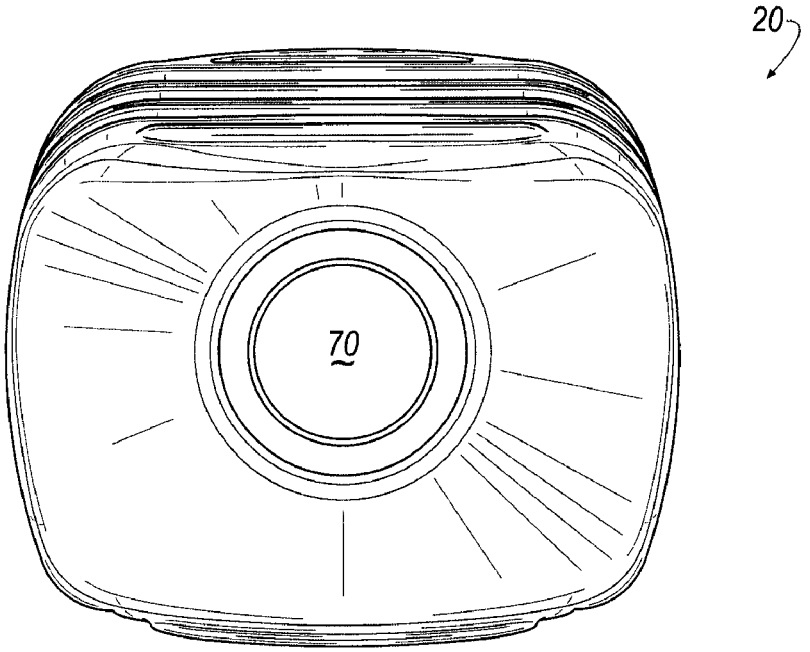
FIGS. 6A, 6B, and 6C are top plan views of embodiment of plastic containers according to embodiments of the invention.
Figure 6B:
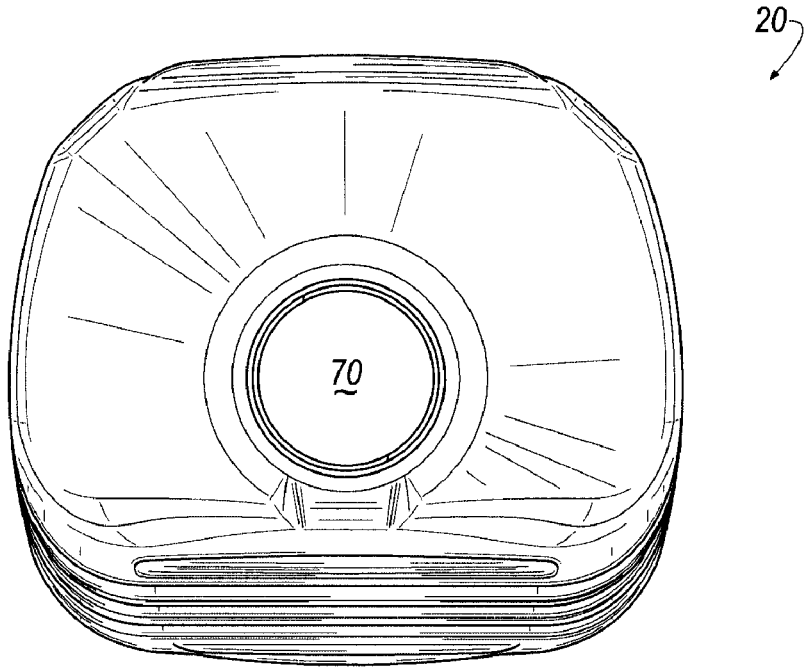
Figure 6C:
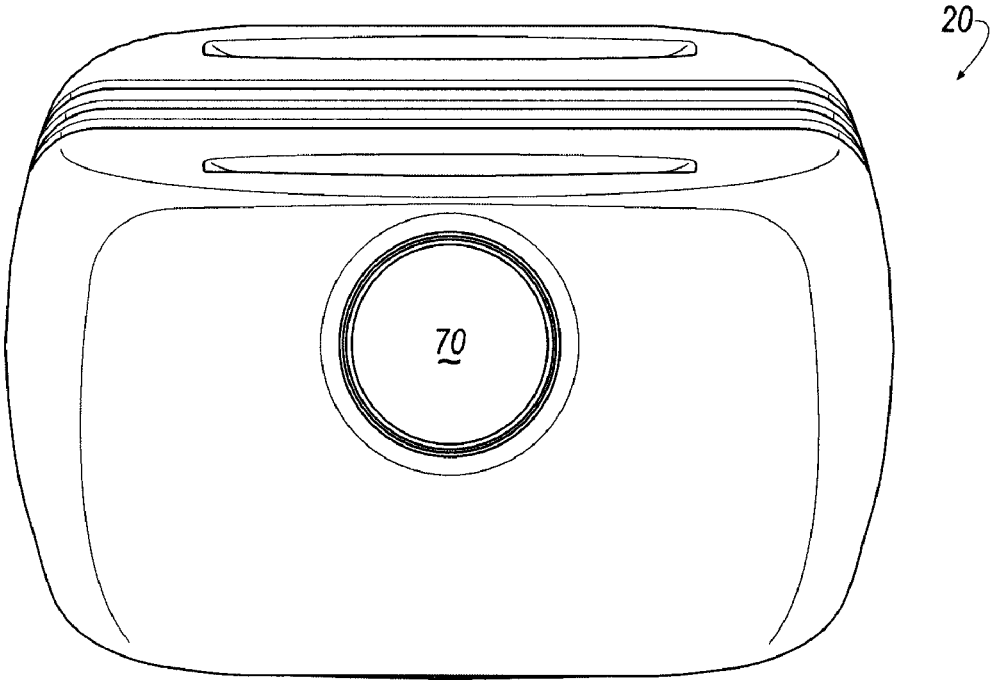
Figure 7A:
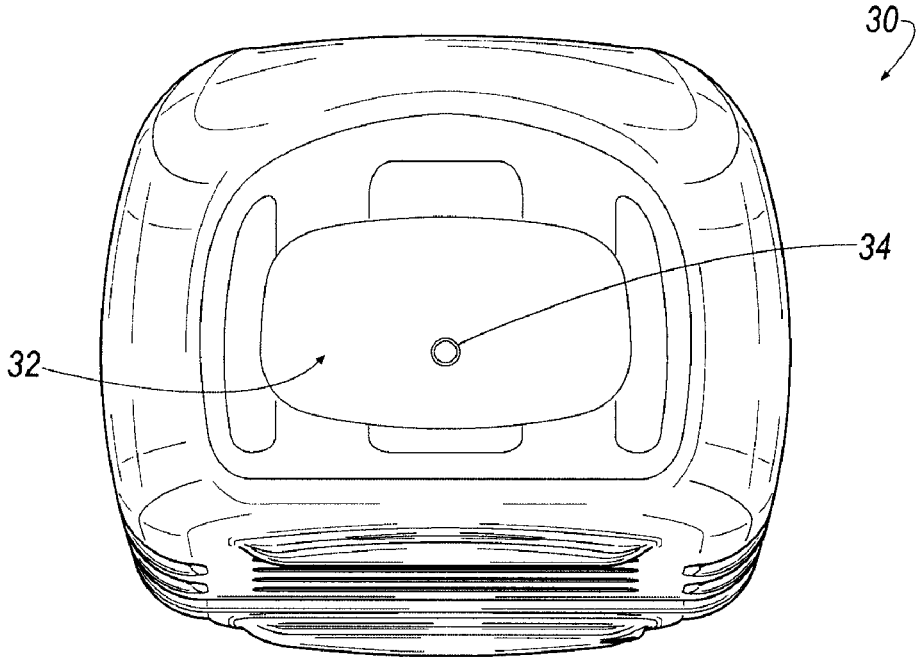
FIGS. 7A, 7B, 7C and 7D are bottom plan views of embodiment of plastic containers according to embodiments of the invention.
Figure 7B:
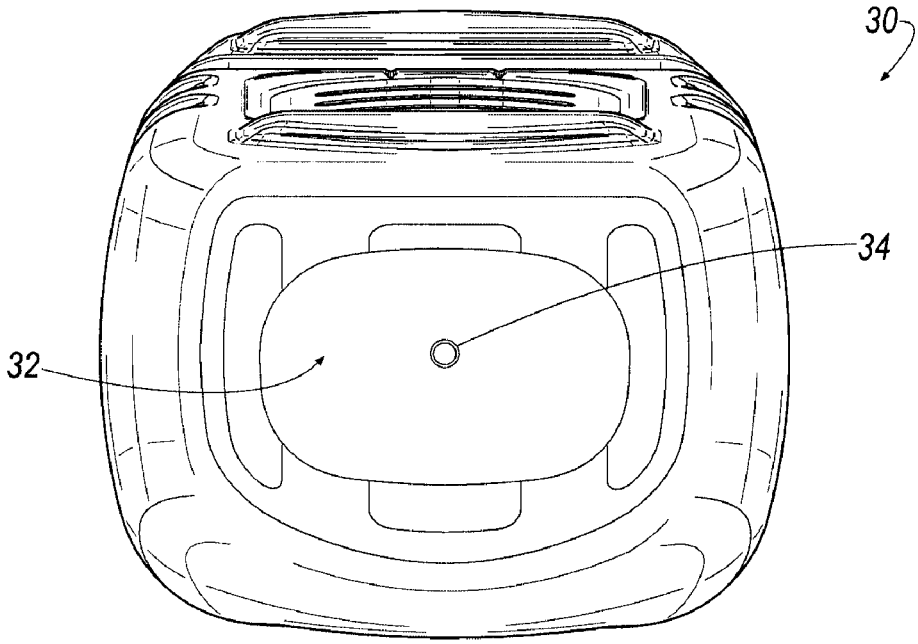
Figure 7C:
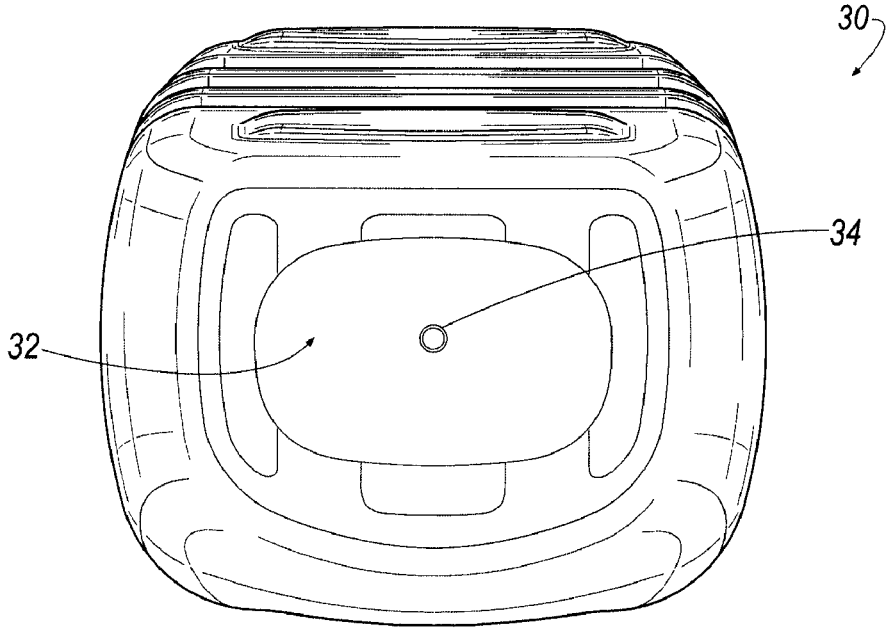
Figure 7D:
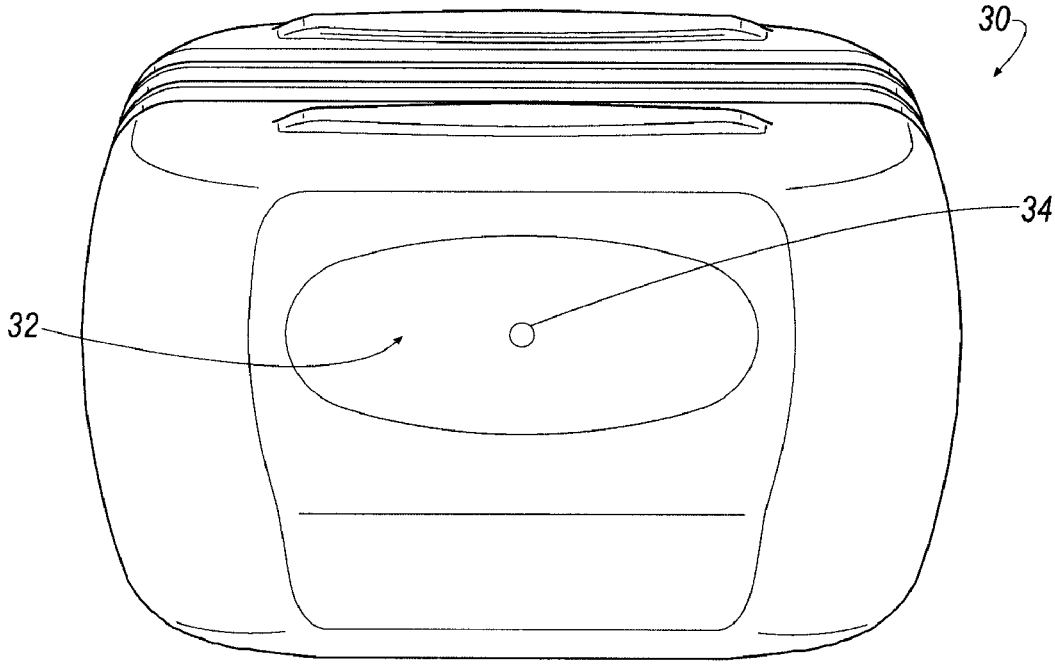

FIGS. 6A-6C illustrate top plan views of several embodiments of containers 20 that include features of the invention. As perhaps better illustrated in FIGS. 5A-5D, different portions of top portion 50 may approach the associated dispensing opening 70 at different angles. For example, with reference to FIG. 5A, illustrated portions 52 and 54 may approach dispensing opening (relative to centerline axis CL) at different angles and/or may have different lengths.

Additionally, FIGS. 7A-7D illustrate bottom portions 30 of embodiments of containers that include features of the invention. By way of example, without limitation, as generally illustrated in FIG. 3B, bottom portion 30 may include (*i*) a raised portion or region 32 (relative to the lowermost portions of the bottom portion 30 and a plane formed by such portions), such as a "push-up," and/or (ii) a bottom point or region 34 in bottom portion 30 that generally is perpendicular to a center point or center range associated with the associated dispensing opening 70—i.e., to generally intersect the associated centerline axis CL. In an embodiment, bottom portion 30 includes a raised portion or region 32 having a bottom point or region 34, and centerline axis CL extends through such bottom point or region 34. Moreover, for some containers in which a blow rod is used to form the container, bottom point or region 34 may coincide with a point of contact for the rod.

Further, for some embodiments, a portion of the bottom portion 30 and/or a portion of side portion at or about the bottom portion 30 (see, e.g., elements 31 in FIG. 5A) may be configured such that the contents of the container are elevated relative to the surface that the container rests upon when the container is positioned on a side portion. Without limitation, with some embodiments, when the container is positioned to rest on a surface on a side portion, gravity may urge the dispensing of at least three-fourths of the fluid contents from a filled container. For other embodiments, the bottom portion 30 and/or portion at or about the bottom portion 30 may be configured with an elevation that would urge $7/8^{ths}$ of the contents from a dispensing opening of a filled container. Aspects of the invention may be employed with containers that hold at least 164 ounces of fluid, as well as containers that hold at least 192 ounces of fluid. However, the invention is not limited to a specific size or volume. Moreover, for some applications, there are benefits to providing a container that is configured to fit on a shelf of a conventional refrigerator. For some embodiments, the area footprint covered by the side portion of the container that may rest on a surface can be about 450 square inches ±50 square inches. For a number of embodiments, the area of the footprint will be 500 square inches or less.

Figure 8:
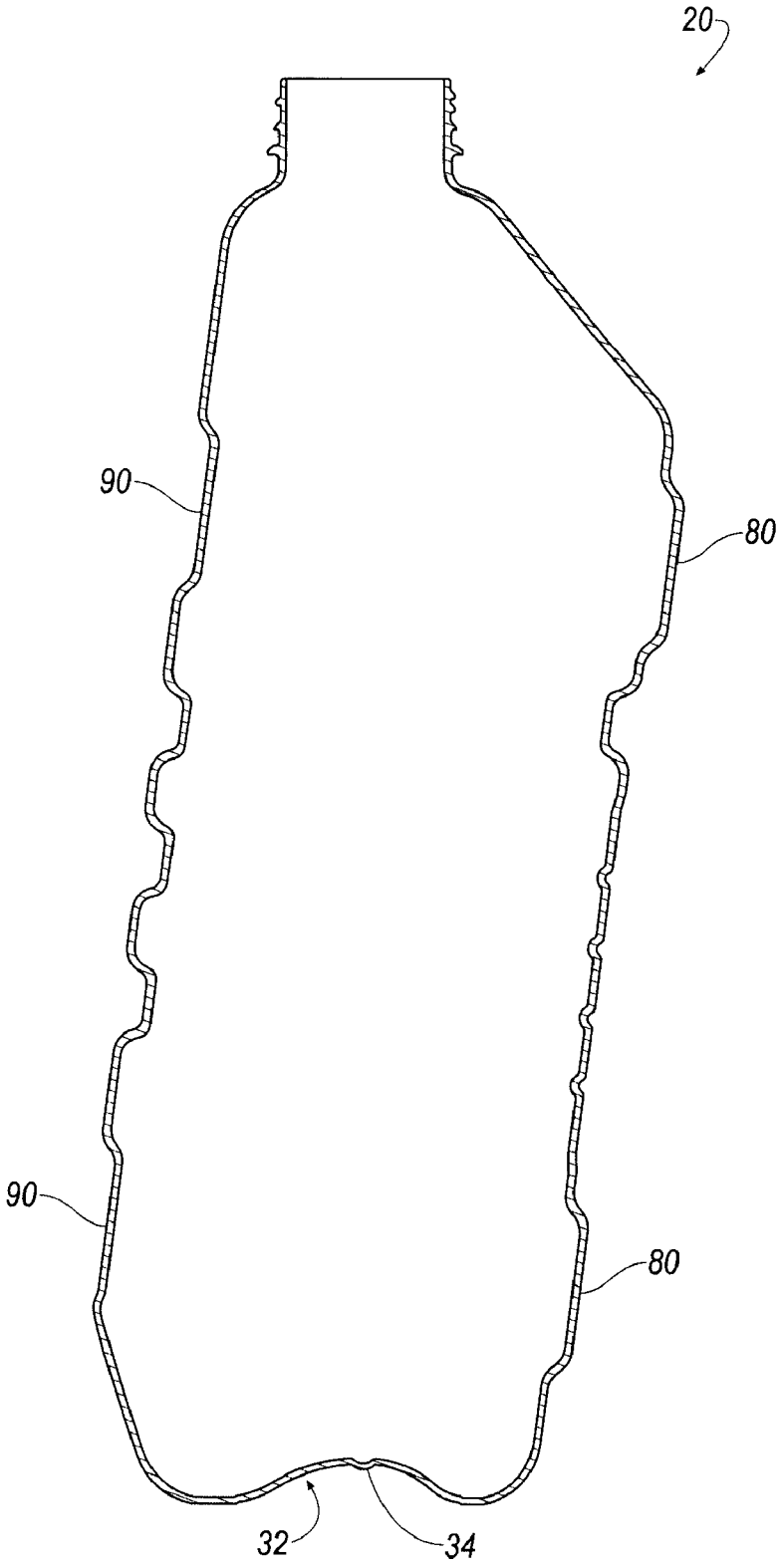
FIG. 8 is a left side sectional view of an embodiment of a plastic container.
Figure 9:
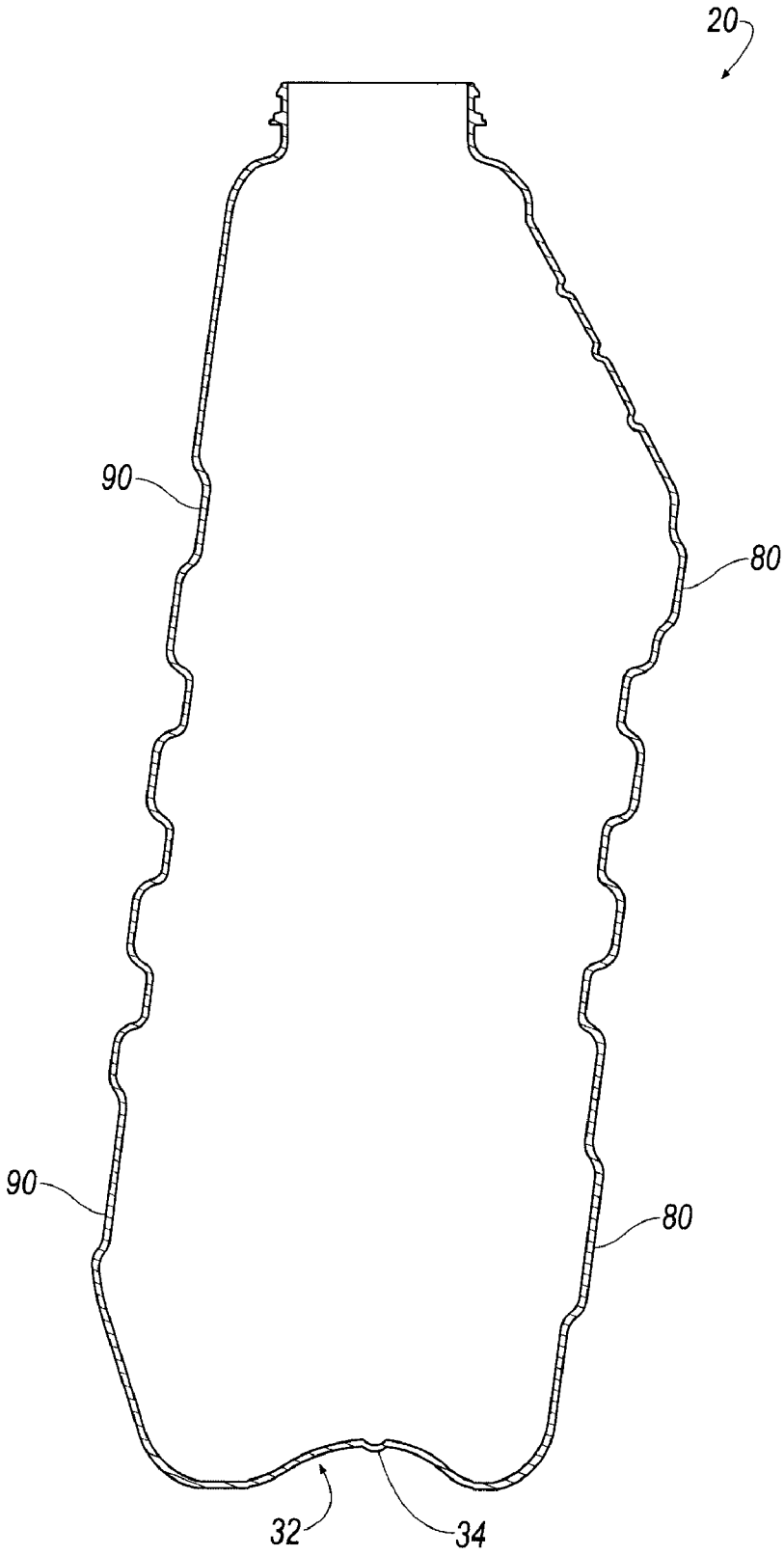
FIG. 9 is a left side sectional view of another embodiment of a plastic container.
Figure 10:
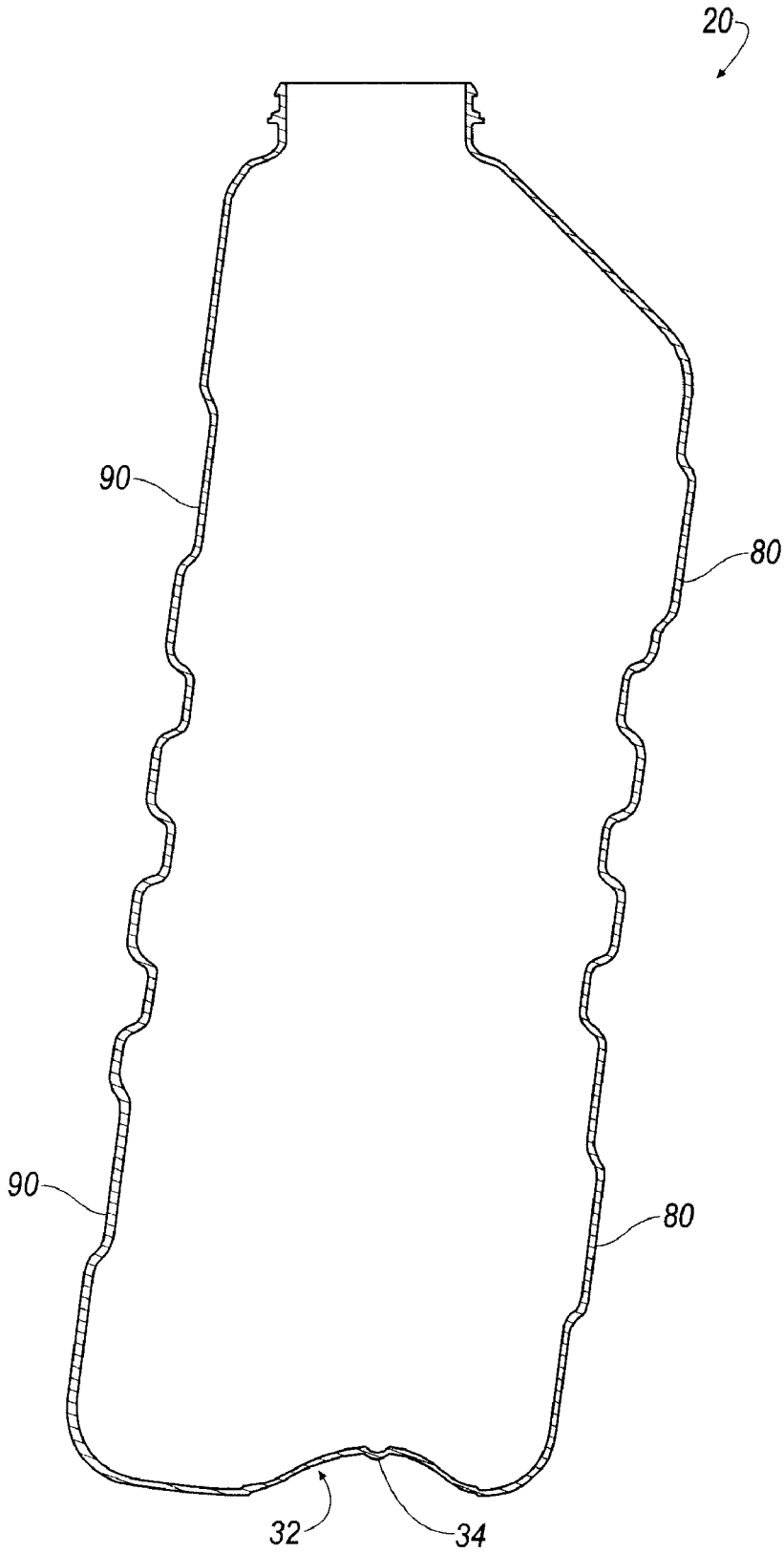
FIG. 10 is a left side sectional view of yet another embodiment of a plastic container.
Figure 11A:
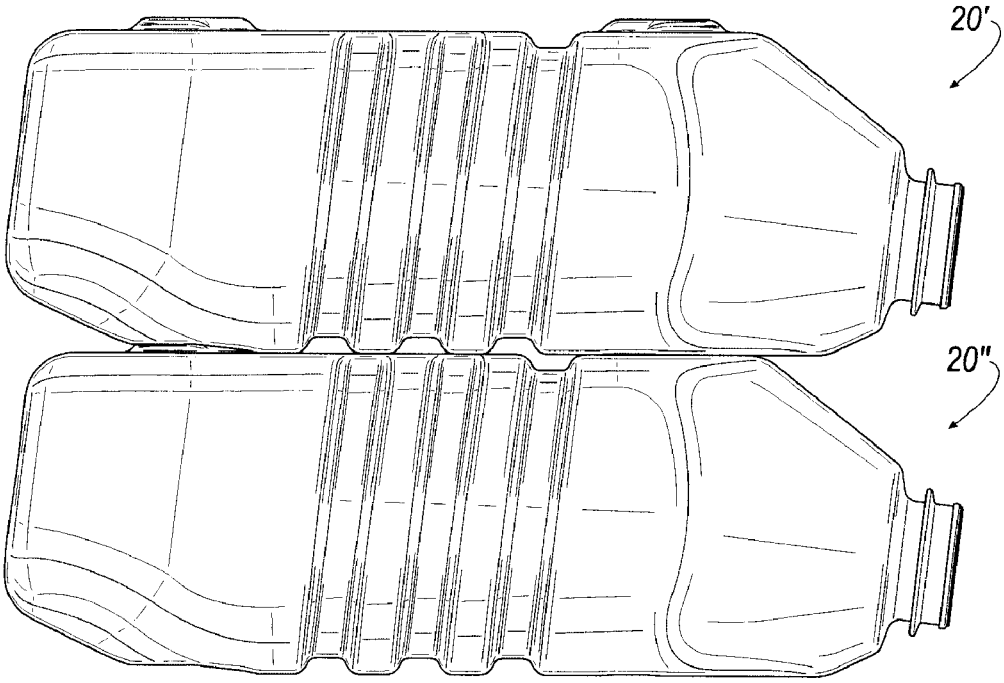
FIGS. 11A and 11B are right side elevation views of two nested plastic containers of the types illustrated in FIGS. 1A and 1B, respectively.
Figure 11B:
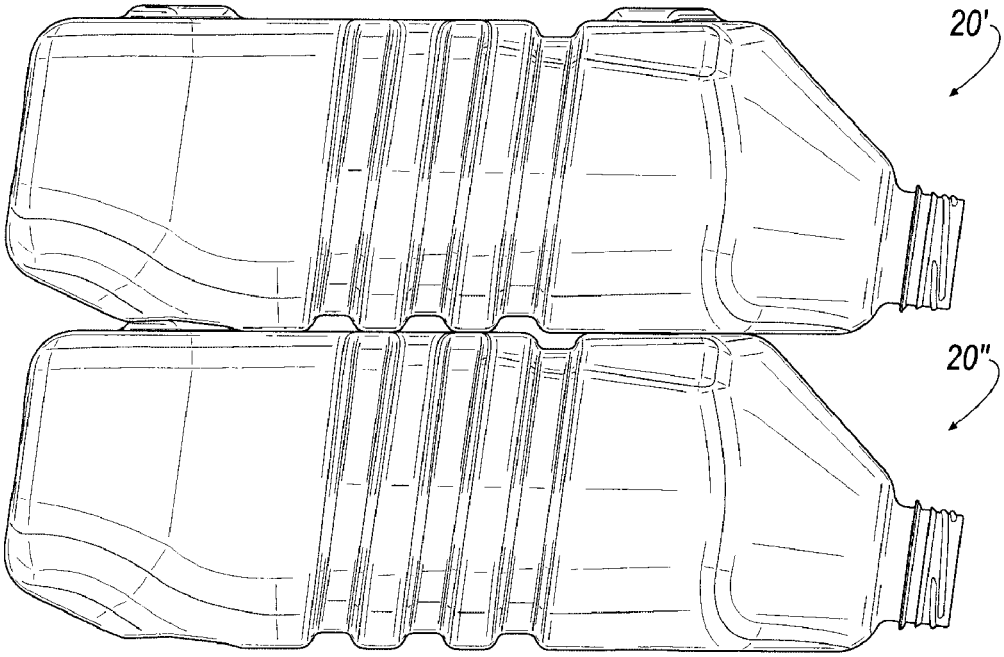
Figure 12A:
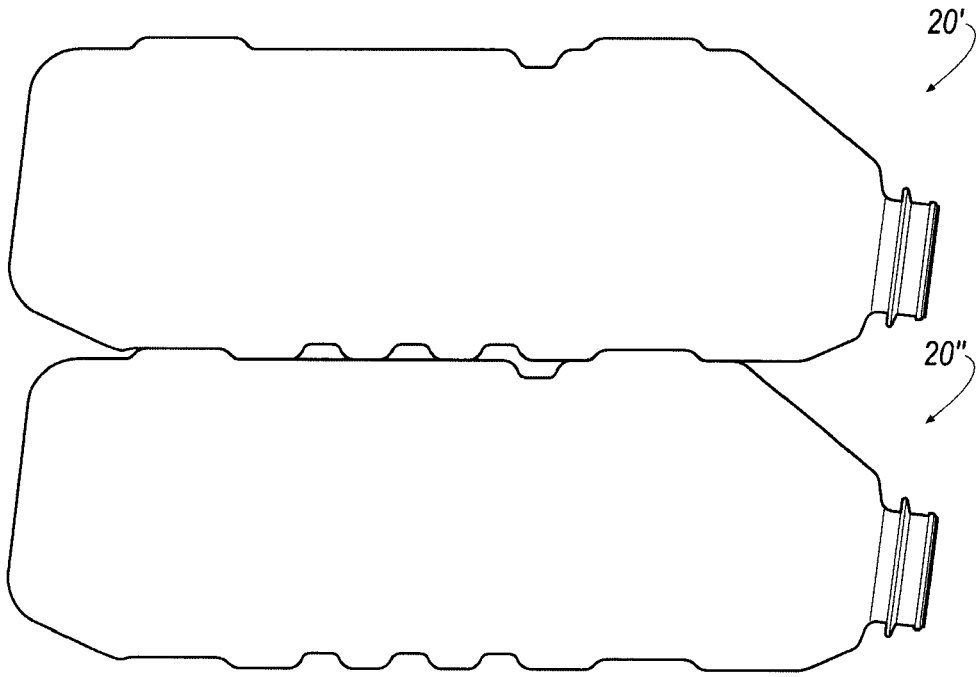
FIGS. 12A and 12B are right side sectional views of two nested plastic containers of the types illustrated in FIGS. 11A and 11B, respectively.
Figure 12B:
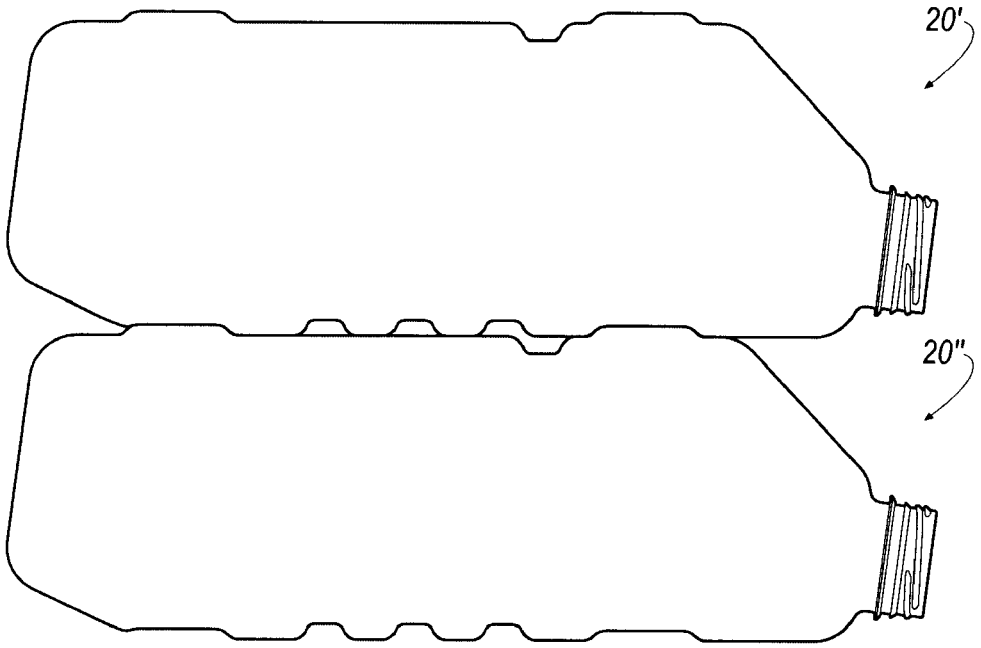

FIGS. 8-10 illustrate side sectional views of several embodiments of plastic containers that include features of the present invention. As generally illustrated, the containers 20 include support protrusions 80 on a side portion that generally are configured to be received in whole or in part in a corresponding receiving portion 90 that is provided on an opposing side portion of the same container. FIGS. 11A and 11B are side elevation views that generally illustrate how two similar containers 20', 20" can be nested together. FIGS. 12A and 12B are side sectional views of containers of the types illustrated in FIGS. 11A and 11B that illustrate how one or more protrusions associated with container 20" may be received by one or more corresponding receiving portions presented in a side portion of container 20'. Such containers 20', 20" may be nested in a stacked (e.g., top-bottom) configuration or, for other applications, may be provided in a side-by-side nested configuration. Further, for some embodiments or applications, when such containers are nested or stacked together, the support protrusion of the side support portion of one container may be in contact with a substantially flat sidewall portion of a second similarly configured container.

By way of example, without limitation, container 20 may be comprised of polyethylene terephthalate (PET), high-density polyethylene (HDPE), polycarbonate, polypropylene (PP), polyvinyl chloride (PVC), or polyactic acid (PLA). Moreover, container 20 may be comprised of recycled material (e.g., PCR). For some embodiments, it is desirable that the container has a degree of clarity with respect to the contents. For such applications, a polymer material that, when molded, provides sufficient clarity may be used. However, those of skill in the art will appreciate that containers of the type associated with the claimed invention may be comprised of various other known polymers and/or combinations of polymers. Moreover, for some embodiments, the containers may, to some extent, include recycled polymer content.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A blow molded plastic container configured to rest substantially horizontally on a surface, comprising:

a body portion having side portions, including at least one side portion comprising a side support portion including a support protrusion extending therefrom;

a top portion connected to the body portion and including a dispensing opening; and a bottom portion connected to the side portions;

wherein when the container rests substantially horizontally on a surface on a side portion the container has a horizontal length that is greater than a vertical height of the container in such resting position, a centerline axis of the dispensing opening is angled with respect to a plane formed by said surface, the centerline axis of the dispensing opening intersects a surface of the bottom portion, the centerline axis of the dispensing opening is substantially perpendicular to the surface of the bottom portion, and gravity will urge at least three-fourths of a contents of a filled container toward the dispensing opening for dispensing therefrom.

2. The container of claim 1, wherein the dispensing opening is substantially cylindrical and extends outwardly from the top portion.

3. The container of claim 2, wherein the dispensing opening includes threads.

4. The container of claim 1, wherein the bottom portion is configured to support the container on said surface.

5. The container of claim 1, wherein the side support portion includes a protruding support formation and an opposing side portion includes a receiving portion for receiving at least a portion of a support formation from a second container of similar configuration.

6. The container of claim 5, wherein an exterior surface of the protruding support portion is substantially entirely received within the receiving portion.

7. The container of claim 1, wherein a portion of the body portion includes at least one strengthening formation.

8. The container of claim 1, wherein the body portion includes a plurality of strengthening ribs.

9. The container of claim 8, wherein each side portion includes at least one strengthening formation.

10. The container of claim 1, wherein at least one side portion includes a label panel.

11. The container of claim 1, wherein the bottom portion includes a raised portion or region that extends inwardly in the direction of the top portion.

12. The container of claim 11 wherein the centerline axis of the dispensing opening extends through a central region of the raised portion or region.

13. The container of claim 1, wherein the side support portion includes at least two spaced apart support formations.

14. The container of claim 13, wherein one support formation is adjacent the top portion, and the other support formation is adjacent the bottom portion.

15. The container of claim 13 wherein the support formations comprise outwardly projecting support pads.

16. The container of claim 13, wherein one or more ribs are positioned between the two spaced apart support formations.

17. The container of claim 13, wherein the side portion opposing the side support portion includes at least two receiving portions for receiving at least a portion of spaced apart support formations form a second similarly configured container.

18. The container of claim 1, wherein a portion of the bottom portion or a portion of a side portion at or about the bottom portion is elevated relative to said surface when the container is positioned on the side portion.

19. The container of claim 18, wherein both a portion of the bottom portion and a portion of the side portion at or about the bottom portion are elevated relative to said surface when the container is positioned to rest on that side portion.

20. The container of claim 1, wherein the body portion is substantially rectangular.

21. The container of claim 1, wherein the container is comprised of polyethylene terephthalate (PET), high-density polyethylene (HDPE), polycarbonate, polypropylene (PP), polyvinyl chloride (PVC), polyactic acid (PLA), or post-consumer recycled (PCR) resin.

22. The container of claim 1, wherein the centerline axis of the dispensing opening is angled downwardly at an angle between about 5° and about 9° with respect to a plane formed by said surface.

23. The container of claim 1, wherein the centerline axis of the dispensing opening is angled downwardly at an angle between about 7° and about 7.5° with respect to a plane formed by said surface.

24. The container of claim 1, wherein, when the container is positioned to rest upon a side portion, gravity will urge at least $7/8^{ths}$ of the contents of a filled container toward the dispensing opening.

25. The container of claim 1, wherein the container is configured to hold at least 164 ounces of fluid.

26. The container of claim 1, wherein the container is configured to hold at least 192 ounces of fluid.

27. The container of claim 1, wherein an area footprint covered by the side portion of container is 500 square inches or less.

28. A blow molded plastic container configured to rest substantially horizontally, the container comprising:

a body portion having side portions, at least one side portion comprising a side support portion that includes a support protrusion extending therefrom, at least one side portion being configured to support the container on a surface;

a top portion connected to the body portion and including a dispensing opening;

a centerline axis of the dispensing opening that is angled with respect to a plane formed by said surface; and a bottom portion connected to the side portions;

wherein when the container rests substantially horizontally on a surface on a side portion the container has a horizontal length that is greater than a vertical height of the container in such resting position, the side portion opposing the side support portion includes a receiving portion for receiving at least a portion of the support protrusion from a second similarly configured container, the centerline axis of the dispensing opening intersects a surface of the bottom portion, the centerline axis of the dispensing opening is substantially perpendicular to the surface of the bottom portion, and gravity will urge at least three-fourths of a contents of a filled container toward the dispensing opening for dispensing therefrom.

29. The container of claim 28, wherein the body portion comprises opposing first and second sidewall portions, and opposing third and fourth sidewall portions; the first and second sidewall portions being wider than the third and fourth sidewall portions.

30. The container of claim 29, wherein the first sidewall portion includes the support protrusion, and the second sidewall portions includes the receiving portion for receiving at least a portion of the support protrusion from a second similarly configured container.

31. The container of claim 28, wherein side support portion includes two spaced apart support protrusions.

32. The container of claim 28, wherein when nested or stacked together, the support protrusion of the side support portion of the container is in contact with a substantially flat sidewall portion of said second similarly configured container.

* * * * *